United States Patent [19]

Halbrook

[11] 3,988,022

[45] Oct. 26, 1976

[54] RACKET STRINGING MACHINE

[75] Inventor: Thurman P. Halbrook, St. Louis County, Mo.

[73] Assignee: Tennis Machines, Inc., St. Louis, Mo.

[22] Filed: June 4, 1975

[21] Appl. No.: 583,647

[52] U.S. Cl. ..... 273/73 A

[51] Int. Cl.[2] ..... A63B 51/14

[58] Field of Search ..... 273/73 A, 73 B, 29 BC, 273/29 BD, 29 BF, 29 BG, 29 BE; 73/145; 272/72, 79 C, DIG. 1, DIG. 4

[56] References Cited

UNITED STATES PATENTS

| | | | |
|---|---|---|---|
| 2,067,563 | 1/1937 | Darby | 273/73 A |
| 2,100,948 | 11/1937 | Doll | 273/73 A |
| 2,188,250 | 1/1940 | Serrano | 273/73 A |
| 2,246,109 | 6/1941 | Serrano | 273/73 A |
| 2,309,849 | 2/1943 | Kausal et al. | 273/73 A |
| 2,971,760 | 2/1961 | Boykin et al. | 273/73 A |
| 3,441,275 | 4/1969 | Held | 273/73 A |
| 3,511,502 | 5/1970 | Spenle | 273/73 A |
| 3,635,080 | 1/1972 | Krueger et al. | 273/73 A X |
| 3,913,912 | 10/1975 | Smith | 273/73 A |

FOREIGN PATENTS OR APPLICATIONS

| | | | |
|---|---|---|---|
| 25,404 | 11/1935 | Australia | 273/73 A |
| 104,900 | 8/1938 | Australia | 273/73 A |
| 471,851 | 9/1937 | United Kingdom | 273/73 B |
| 486,825 | 6/1938 | United Kingdom | 273/73 A |
| 528,985 | 11/1940 | United Kingdom | 273/73 A |
| 839,443 | 6/1960 | United Kingdom | 273/73 A |

*Primary Examiner*—Richard J. Apley
*Attorney, Agent, or Firm*—Charles B. Haverstock

[57] ABSTRACT

An improved apparatus for stringing rackets such as tennis rackets and the like including improved means for locking the racket against movement in different fixed positions during stringing to prevent loss of string tension, improved string gripping and holding means, improved bearing means for the string tensioning means to improve the accuracy thereof, improved and more universal means for clamping a racket in position on the stringing machine including means by which a greater range of racket types, sizes, and shapes can be accommodated, and improved means for adjusting the operating speed of the machine.

11 Claims, 11 Drawing Figures

RACKET STRINGING MACHINE

Racket stringing devices have been in use for many years and many different embodiments and forms of such devices are known. Several such racket stringing devices which have been in use for many years and which have been particularly accurate and reliable are disclosed in Serrano U.S. Pat. Nos. 2,154,870 and 2,188,250. The devices disclosed in the Serrano patents have been particularly useful and suitable for stringing rackets such as tennis and other type rackets and especially rackets which have string holes through the frame which extend radially outwardly therethrough. Many of the basic features of the Serrano machines are still in use, and the subject improvements are intended to be applied to machines such as the Serrano type machines as well as to others to increase their versatility and usefulness, to make them more accurate and to make them adaptable to stringing a greater variety of rackets and racket types including rackets in which the string is no longer threaded through radially extending holes in the racket frame but rather loops back and forth across the frame between inwardly extending loop portions of a formed wire member which is wound or otherwise attached to the frame during construction of the racket.

Certain problems arise in the stringing of wire wound rackets which do not arise when stringing rackets with holes through the frame. These include problems of holding the racket steady and in fixed position and preventing it from rotating in order to prevent string slippage, loss of string tension and other problems which arise when the string tension is applied by pulling on and winding each reach of the string after it has been passed through a wire loop and extends back across the racket. These and other problems are solved by the subject improvements including also the problem of providing improved means for clamping wire wound rackets in place on the machine and preventing such rackets from moving when the string tension is applied and held. The subject improved means for clamping a racket in place on the machine are also adjustable to be able to accommodate more different sizes, shapes and styles of rackets, and the present improvements also facilitate the gripping and holding of the string in different positions and without requiring as much attention and adjustment by the operator. Being able to adjust the speed of movement of the string tension applying means as taught by the present improvements has the further advantage of speeding up the stringing operation and making it possible for a skilled stringer as well as a newcomer to string rackets at their own desired speeds.

It is therefore a principal object of the present invention to provide an improved racket stringing machine which is able to accommodate a greater variety of sizes, shapes and types of rackets.

Another object is to provide improved adjustable means for holding a racket during a stringing operation.

Another object is to provide means in a racket stringing device to prevent movement of a racket and an accompanying loss of string tension.

Another object is to provide means on a racket stringing device to reduce the time required to string a racket.

Another object is to provide adapter means for use on a racket stringing machine to make the machine able to accommodate a greater variety of different kinds of rackets.

Another object is to provide improved bearing means for use on racket stringing machines and the like to improve the uniformity and accuracy of the tension being applied.

Another object is to provide improvements which can be used on new racket stringing devices as well as to modify and improve existing devices.

Another object is to increase the versatility of a racket stringing machine without substantially increasing the complexity or cost thereof.

Another object is to provide improved and more automatic means for gripping and holding the string in a racket stringing machine.

Another object is to reduce the labor required to string rackets and the like.

Another object is to provide a relatively inexpensive versatile racket stringing machine which is adaptable for use commercially as well as for personal use.

These and other objects and advantages of the present invention will become apparent after considering the following detailed specification which discloses preferred embodiments of the present improvements in conjunction with the accompanying drawings, wherein.

Figures 1, 7, 8, 10, 11:
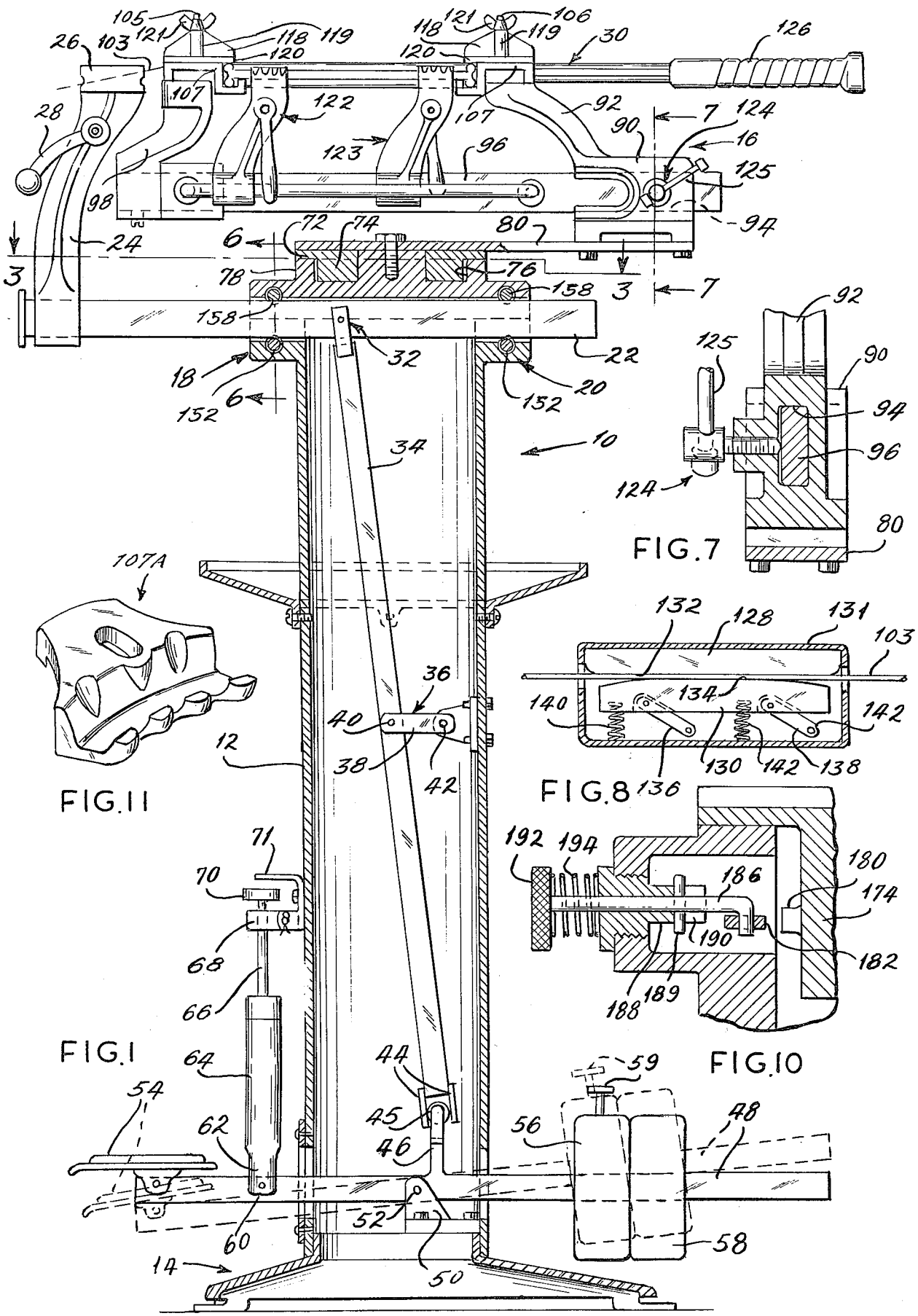
FIG. 1 is a side elevational view partly in cross-section showing a racket stringing machine embodying the subject improvements.
FIG. 7 is an enlarged cross-sectional view taken on line 7—7 of FIG. 1.
FIG. 8 is a top plan view showing a modified form of the split head string gripping and holding means.
FIG. 10 is an enlarged cross-sectional view taken on line 10—10 of FIG. 9; and, FIG. 11 is an enlarged perspective view showing an alternative adapter device for use in clamping a racket in position on the subject machine.
Figure 2:
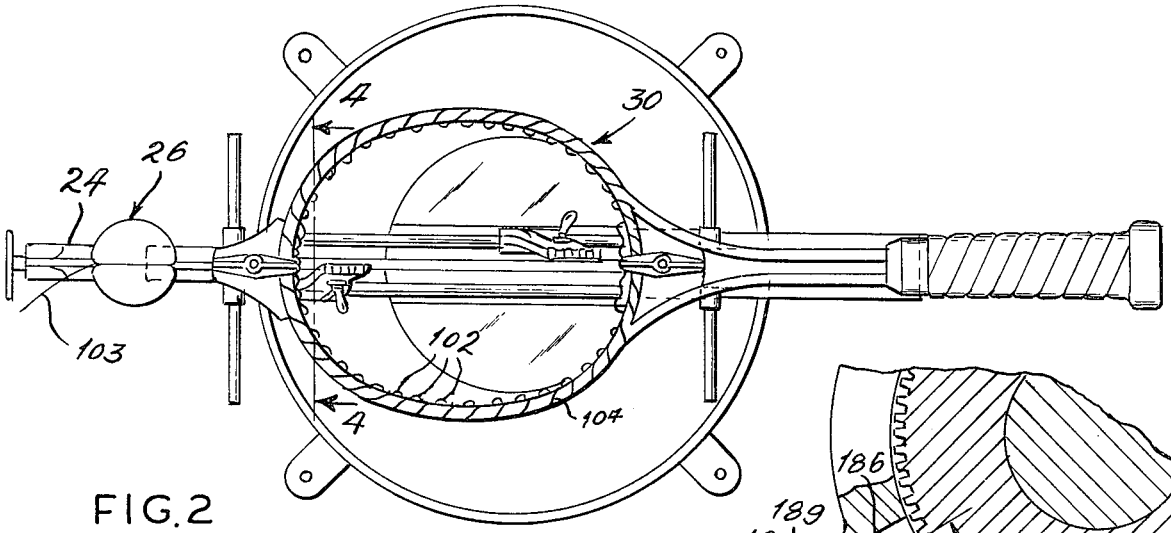
FIG. 2 is a top plan view of the machine of FIG. 1 showing a racket in position to be strung thereon.

Referring to the drawings more particularly by reference numbers, number 10 refers to a racket stringing machine having improvements constructed according to the present invention. The machine 10 includes a vertical column 12 which is attached at its lower end to a base or pedestal portion 14, and at its upper end the column 12 carries portion 16 where a racket is mounted and held in position while the stringing takes place. Also attached to the upper end of the column 12 are aligned bearing housings 18 and 20 which slideably position a horizontal bar 22 which is part of the string tensioning mechanism. The bar 22 is slideably positioned in the bearing housings 18 and 20 as will be later described, and one end of the bar 22 carries string tensioning means of which several forms are disclosed, the form shown in FIGS. 1 and 2 including a vertical support 24, a split clamping head 26, and a clamping lever 28 which is movable between a position in which the portions of the split head 26 are separated from each other and a position in which the portions of the split head 26 are moved toward each other and toward the string that is placed therebetween to clamp and hold the string after it has been threaded through racket 30 and while tension is applied thereto. The string clamping means shown in FIGS. 1 and 2 is of conventional construction while the form shown in FIG. 8 is modified and will be described later.

The tension bar 22 extends through the journal housings formed by housing portions 18, 20 and 78 and across the upper end of the column 12. The portion of the tension bar that is between the journals 18 and 20 is pivotally connected at 32 to the upper end of a pendulum bar 34 which is pivotally attached to one side of the column 12 by means of a link assembly 36 which includes link 38 and pivot means 40 and 42. The pendulum bar 34 extends from its upper end which is pivotally attached to the tension bar 22 downwardly inside the column 12 to its lower end which includes spaced parallel members 44 located on opposite sides of a roller 45. The roller 45 is journaled to the upper end of an arm 46 which is connected to pedal bar 48. The pedal bar 48 is mounted for pivotal movement to upwardly extending portions of a pedal bracket 50 at 52, and the pedal bracket 50 is connected to the pedestal 14.

The pedal bar 48 extends from opposite sides of the column 12, and pedal 54 is attached to one end thereof, and the opposite end of the pedal bar 48 carries one or more weights 56 and 58 which can be positionally adjusted thereon. One or more of the weights may include means such as threaded member 59 to lock it in a desired position on the bar 48. The pedal bar 48 is also connected by pivot means 60 and a bracket 62 which is attached to or forms the lower end of a pressure cylinder assembly 64. The cylinder 64 has a piston and rod assembly 66 extending upwardly therefrom to a member 68 which is attached to the column 12 as shown. The piston and rod assembly 66 includes an adjustment knob 70 which can be rotated to adjust the force required to move the piston and rod assembly 66 in the cylinder 64 and hence to adjust the force required to operate the foot pedal 54 and the speed at which tension is applied to the string. The purpose of the knob 70 is therefore to vary the force required to move the assembly 66 in order to change the operating speed of the device. For example, the knob 70 can be adjusted so that the pedal bar 48 will move very slowly, or it can be adjusted to permit rapid movements of the pedal bar and the parts associated therewith. This adjustment can be reset for each operator depending upon his skill and training and on the speed at which he desires to string a racket. The damping action of the cylinder assembly 64 is important to the operation especially as it controls the speed at which the string tension is applied to the string through the tension bar 22 and through the tension clamping means attached thereto.

The member 68 which supports the upper end of the piston and rod assembly 66 is shown including an overhead tab or flange 71 which is provided to limit upward adjustment of the assembly 66 and to prevent the assembly from accidentally being separated from the cylinder 64. It should also be noted that the pedestal 14 is preferably made to extend further outwardly from the column 12 on the side where the weights 56 and 58 are located. This is done to reduce the possibility for the machine to overturn especially when the weights are located relatively far out on the bar 48.

Of importance to the present invention are the means that are used to clamp and lock the racket 30 and the associated support parts therefor in different fixed positions on the device during stringing, and to prevent rotation thereof except when necessary to the stringing operation. Several different means for accomplishing this are disclosed. One of the means includes a member shown as round plate 72 which is mounted at the upper end of the pedestal column 12. The plate 72 has an annular depending portion 74 (FIG. 3) extending downwardly from the lower surface, and the portion 74 extends downwardly into an annular cavity or groove 76 formed in the upper surface of a stationary member 78 attached fixedly to the upper end of the column 12.

Figure 9:
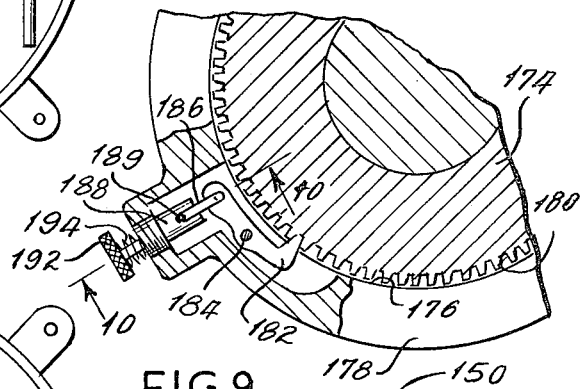
FIG. 9 is a fragmentary cross-sectional view taken at a location similar to FIG. 3 and showing a modified form of the brake means.

A horizontal support bar 80 is attached to the upper surface of the plate 72 and extends outwardly therefrom in one direction, and the members 72 and 80 are journaled for rotational movement relative to the member 78. The stationary member 78 has a sidewardly extending cutout portion 82 formed in it which communicates with the annular groove 76 on one side as clearly shown in FIG. 3. The cutout 82 is provided to accommodate a locking member or brake shoe 84 which is positioned therein and which is connected to the end portion of a threaded shaft 86 which is positioned therein and which extends through a threaded opening in the member 78. The opposite or outer end of the shaft 86 carries a locking lever 88 which when rotated in one direction moves the brake shoe 84 inwardly against the outer surface of the annular portion 74 on the plate 72 to prevent it from rotating. When the lever 88 is rotated in the opposite direction the brake shoe 84 moves out of engagement with the annular portion 74 thereby releasing the portion so that it, the attached arm 80, and the members supported thereon including the racket support means can rotate relative to the member 78. The brake shoe 84 and the lever 88 therefore provide means not required when stringing prior rackets to lock the racket and the racket support means in any desired fixed position. The locking means using the lever 88 are such that they can be operated relatively quickly and easily, but they do require operator attention and take some time to use. However, they do enable the present stringing device too be used to string more different kinds of rackets including rackets which do not have the string pass through holes in the racket frame. Another form of locking means is shown in FIG. 9 and has added advantage in that it can be operated faster than the brake shoe construction, it is not as subject to wear, and it does not depend on the strength of the operator. Also by eliminating the threaded shaft 86 a major cause of potential trouble is eliminated. The modified locking means of FIG. 9 will be described later.

The arm 80 which is attached to the member 72 is a relatively rigid member preferably constructed of steel and is the main support for many of the components included in the subject device including the components which hold the string after it has been tensioned and maintain the string under tension and until the succeeding reach of string is in place and tensioned. The arm 80 also supports the means on which the racket is mounted.

Figure 4:
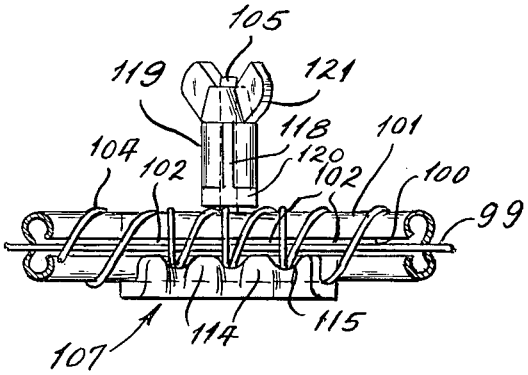
FIG. 4 is an enlarged cross-sectional view taken on line 4—4 of FIG. 2.

On the free end of the arm 80 is fixedly positioned a support member 90 which extends upwardly therefrom as indicated by the curved portion 92. The member 90 has a rectangular shaped passage 94 extending therethrough and the passage 94 receives a bar 96 which has another upwardly extending support member 98 attached near its opposite end. In the past, support members such as the spaced support members 92 and 98 have included means for directly mounting a racket thereon in such a manner that the string holes through the racket frame are all accessible for passing the string through. However, as explained some of the more modern rackets do not have string holes through the frame but instead have a formed wire member 99 which is positioned in an inwardly facing groove 100 formed in the inner surface of the racket frame 101 (FIG. 4), and which has inwardly extending loop portions 102 through which the string 103 is threaded back and forth and across the racket. With this type of construction the string 103 does not need to pass through the frame as in the past and to accommodate the stringing of this kind of racket requires modifications of the racket support means since the tension applied to the string is applied by pulling on the string after it passes through one of the wire loops 102 from a location on the opposite side of the frame from the last wire loop 102 through which the string 103 extends. This is opposite from pulling the string straight on after it passes through a radial hole in the racket frame as in the past. This means that when the subject machine is used to string a wire wound racket there will be a tendency for the racket to want to turn since the tension forces are applied across the racket frame which has not been so in the past. The wire member 99 is attached and held in the groove 100 in the frame 101 by another wire 104 which is coiled around the frame during manufacture of the racket 30.

Figure 5:
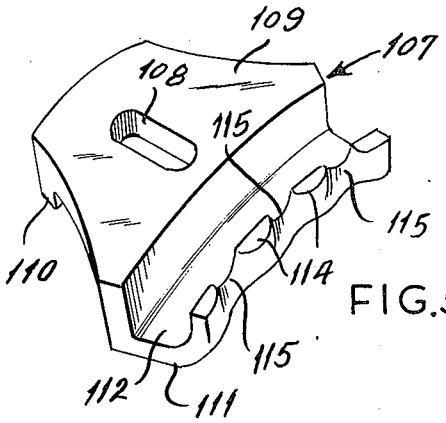
FIG. 5 is an enlarged perspective view showing an adapter device for use in clamping a racket in position on the subject machine.

The racket support means include upwardly extending threaded members 105 and 106 which are attached respectively to the support members 98 and 92. The threaded members 105 and 106 each receives a respective adapter member 107 (FIG. 5) that has an elongated hole 108 that is used to mount it on the respective threaded member 105 or 106. Each of the members 107, of which two are required, has a central relatively flat portion 109, and spaced depending locating flanges 110 and 111 which extend downwardly from opposite sides thereof. The flanges 110 and 111 are shown as being rounded and the flanges 111 have rounded channels 112 formed in the upper surfaces thereof to accommodate a portion of the racket frame 101. The inner upwardly extending edges of the round flanges 111 are scalloped at 114 to provide spaced indentations 115 at the locations where the spaced inwardly extending wire loops 102 are located. This is done so that the wire loops 102 will be as accessible as possible to receive the string and so that the string can be held under tension as close as possible to its final position on the racket 30. One of the members 107 is positioned on each of the upwardly extending threaded members 105 and 106 with their rounded channels 111 spaced apart to accommodate and engage opposite sides of the racket frame 101. When the racket is positioned as shown in FIGS. 1 and 2, other members 118 which are positioned on each of the threaded members 105 and 106 are used to lock it in place. The members 118 have central tubular portions 119 and elongated right angle base portions 120 which are long enough so that when properly oriented one end of the base portion 120 on each member 118 will engage the upper surface of the racket frame 101 above where the racket is positioned in respective rounded channels 112. Finally, each threaded member 105 and 106 threadedly receives a locking member shown as wing nuts 121 which when tightened down will cause the members 118 to move downwardly against the upper surfaces of the racket frame 101 to hold the racket in clamp position on the rounded channels 112. FIG. 11 shows an alternative embodiment 107A of the adapter device 107 depicted in FIG. 5. Members such as members 107A are utilized in place of members 107 when clamping smaller rackets such as squash rackets in position. Various embodiments of the adapter device, customized to racket styles or types, may be advantageously employed to optimize both access to and restraint of a particular racket.

The upper portion 16 of the subject device also includes adjustable string holding devices or clamps 122 and 123, and these may be similar to those employed in the past including having portions with toothed upper ends which enable them to extend into the spaces between adjacent lengths of string when the device is tensioning the reaches of strings that extend crosswise of string reaches that have been previously applied and tensioned. The construction and operation of the string clamp means 122 and 123 are not part of the present improvements as such.

In order to string a racket using the subject machine the racket is first clamped in fixed position on the spaced supports 92 and 98 as described and as shown in FIGS. 1 and 2. This requires placing one of each of the members 107 and 118 on the respective threaded shafts 105 and 106. To do this it may be necessary to adjust the spacing between the support portions 92 and 98 and between the members 107 that accommodate the racket. This space may differ widely for different rackets and different kinds of rackets such as for tennis rackets, squash rackets, paddle ball rackets, badminton rackets and so forth. This adjustment is made by loosening locking screw assembly 124 which is threaded into the member 90 preferably on the side thereof where it is easily accessible and where considerable pressure can be applied without unduly stressing the member. This adjustment is made by turning the handle 125 on the assembly 124 first to loosen the bar 96, and thereafter when the adjustment is set to lock the bar 96 in position. These features are shown in FIGS. 1 and 7.

Thereafter, with the racket in position the members 118 are turned to positions so that they engage the upper surfaces of the racket frame 101 as shown in FIG. 1, and the wing nuts 121 are tightened to hold the racket in place. With the racket held in the manner described, one end of the string 103 is locked in position or tied to the racket frame 101 in the usual manner and at the usual location, and the racket is ready for stringing. The stringing is accomplished by threading the string 103 back and forth one reach at a time between the spaced opposite pairs of the inwardly extending wire loop portions 102 of the wire 99, and after each loop 102 is strung the tension means are used to apply the desired tension thereto. The racket must be rotated and relocked in position for each string tensioning operation. The handle portion 126 of the racket 30 which extends outwardly from the machine may be used to help in repositioning the racket at these times.

With one end of the string 103 anchored to the racket frame 101, the rest of the string is brought across the racket and through the appropriate wire loop 102 formed by the wire 99 at the opposite side of the racket frame. Each time the string 103 is threaded through another loop 102 it is pulled back and drawn taut by the tensioning means and one or the other of the clamping members 122 or 123 is moved to a proper position to engage and hold the string while the next reach of string is drawn through the succeeding wire loop 102 and passed back across the frame and tensioned. Any misalignment or movement of the racket during tensioning will adversely effect the tension and will also cause or try to cause the racket to rotate. Therefore, unless a wire wound racket is held firmly when the tension is applied the racket tension may vary, and the racket will not be properly strung. To solve this problem as indicated, the present construction includes the braking means one form of which includes the brake shoe 84, the brake lever 88 and the annular brake drum 74. This form of brake has the disadvantages noted including the fact that it requires time to apply the braking force and it repeatedly applies substantial force on threaded members and this will eventually cause wear. Different operators will also apply different pressure to the lever 88 and this likewise is undesirable. Furthermore, each time the racket is in position to have another reach of string tensioned, the racket will have been properly reoriented relative to the tensioning means and this is done with the brake 84 released, and thereafter the lever 88 will be turned to move the brake shoe 84 against the annular member or brake drum 74 on the member 72 to relock the racket against further movement. The braking force is always applied when the racket is in as close position as possible to the position in which the string reach being tensioned will be when the racket is completely strung. across the frame and tensioned. Any misalignment or movement of the racket during tensioning will adversely effect the tension and will also cause or try to cause the racket to rotate. Therefore, unless a wire wound racket is held firmly when the tensiion is applied the racket tension may vary, and the racket will not be properly strung. To solve this problem as indicated, the present construction includes the braking means one form of which includes the brake shooe 84, the brake lever 88 and this likewise is undesirable. Furthermore, each time the racket is in position to have another reach of string tensioned, the racket will have been properly reoriented relative to the tensioning means and this is done with the brake 84 released, and thereafter the lever 88 will be turned to move the brake shoe 84 against the annular member or brake drum 74 on the member 72 to relock the racket against further movement. The braking force is always applied when the racket is in as close position as possible to the position in which the string reach being tensioned will be when the racket is completely strung.

In order to tension a reach of the string, the operator presses down on the foot pedal 54 thereby causing the pivot means formed by members 44 and roller 45 to move to the left as shown in FIG. 1. This causes the pendulum bar 34 to move in a clockwise direction about the pivot 42. Some rotational movement of the link 38 about the pivot 42 may also take place but this is not objectionable. In the process the upper end of the pendulum bar 34 moves to the right, and in so doing moves the string tension clamping assembly formed by the members 24, 26 and 28 to the right or toward the racket 30. The operator now rotates the lever 28 to a position wherein the split head portion 26 of the string tensioning means opens up so that the string can be placed between the two portions thereof and held. The lever 28 is now moved to a position reclosing the split head 26 so that it grips and holds the string securely. The operator now takes his foot off the pedal 54 so that the weights 56 and 58 are able to move the bar 48 clockwise about the pivot 52 and in opposition to the damping action of the cylinder 64. As soon as the pedal is released, the weights 56 and 58 commence to move downwardly and to move the lower end of the pendulum bar 34 to the right. This in turn moves the bar 22 and the string tensioning means attached thereto to the left applying pressure to the string that is now held by the split head 26. The amount of pressure that is applied will depend upon the weight and position of the weights 56 and 58 on the bar 48. This is adjustable as required.

FIG. 8 shows an improved embodiment of the string clamping and holding means to replace the more conventional split head 26 which requires manual opening and closing. In the improved construction, the string 103 is positioned between two members 128 and 130, one of which is stationary and the other movable. The members 128 and 130 are shown positioned in a housing 131 and have adjacent relatively smooth clamping surfaces 132 and 134, respectively. The string 103 is positioned extending between these surfaces during a stringing operation. The surfaces 132 and 134 should also have rounded ends and edges so as not to damage the string when it is being positioned therebetween and when it is being drawn therethrough. The member 128 is shown as being a stationary member and the member 130 is shown supported for movement relative to the member 128 on two pivotal link members 136 and 138. One or more springs such as compression springs 140 and 142 are provided to bias the member 130 toward the member 128 and toward a length of the string 103 positioned between the surfaces 132 and 134. With this construction the string can be easily pressed into position between the members 128 and 130 and when so positioned it can be easily pulled in one direction (to the left as shown) between the members 128 and 130, but it cannot be moved or pulled in the opposite direction because of the camming action of the link members 136 and 138 combined with the action of the compression springs 140 and 142. This construction of the string gripping and holding means has the advantage of eliminating the need for the lever 28 and makes it possible for the operator to reposition the string 103 in the clamp by simply pulling on the string always in the same direction at those times when the pedal 54 is depressed. This therefore speeds up the operation, reduces the chances for wear, and keeps the loose end of the string in a more advantageous position which is remote from the other mechanisms.

The string clamping and holding means shown in FIG. 8 are mounted on a member such as the member 24 and tension is applied to a string portion extending therethrough under control of the pedal 54 and the weights 56 and 58.

The hydraulic cylinder 64 as explained controls the speed at which the operator can depress the pedal 54, and the speed at which the weights 56 and 58 can move downwardly to apply tension to the string. This can be adjusted by means of the knob 70 to satisfy any particular application. After the string tension has been applied as aforesaid, the tension can be maintained by operation of one or the other of string clamping means 122 or 123. This frees the previously used clamping means 122 or 123 which can then be released and repositioned to clamp and to hold the next reach of string after tension is applied thereto as aforesaid. Each time another reach of string is tensioned and held the brake means such as the brake shoe 84, or the preferred brake means to be described later, is released so that the racket 30 can be rotated to the next position for stringing. The procedure just described is repeated until all of the string reaches for one direction are threaded on the racket after which the same or a different string is threaded crosswise in a weaving pattern using the same procedure until the racket is completely strung and the free ends tied to hold the tension.

One feature of racket stringing device that has caused trouble in the past is the form of the bearing means used to support and guide the string tension bar 22. The bar 22 must be as friction free and freely movable as possible so that friction and binding have a minimal effect in the string tension applied through the various linkages that connect the string gripping and holding means to the weights 56 and 58. The bearing means used heretofore for the most part have included open exposed bearing members which have been subjected to undesirable dirt accumulation, looseness, and premature wear. The known bearing means have also been relatively expensive to make because they require fairly difficult machining operations, and it has been difficult and costly to repair or replace the known bearings. The known bearing means also contribute to producing undesirable friction in the transfer of the tension forces between the weight means 56 and 58 and the spring gripping and holding means when the tension is applied. Any friction and wear in these connections is undesirable and produces inaccurate and unreliable results and can adversely effect the tension of the racket. To overcome this, the subject improvements include a new style of bearing means for supporting and guiding the arm 22. The improved bearing means are more clearly shown in FIG. 6 and are relatively trouble free, are easily lubricated, are not as exposed as prior bearing means used for the same or similar purposes, they are sturdy and they are relatively resistant to being clamped. Furthermore, with the present construction the arm 22 can be made to have a rectangular cross-sectional shape over its full length thereby substantially reducing its cost of manufacture.

Figure 6:
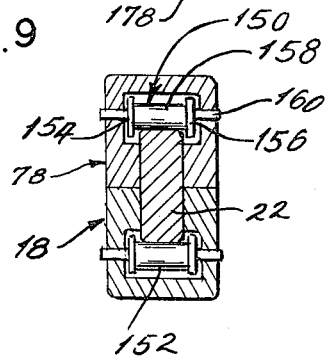
FIG. 6 is an enlarged fragmentary cross-sectional view taken on line 6—6 of FIG. 1.

The subject bearing means include two or more pairs of vertically spaced spool shaped bearing members 150 and 152 positioned in the structures formed by housing portions 18, 20, and 78 to engage the upper and lower edges of the arm 22. In FIG. 6 the upper spool 150 as shown has flanged end portions 154 and 156 and a central cylindrical portion 158 which engages the upper surface of the arm 22 with sufficient running clearance being provided between the flanges 154 and 156. The lower bearing spool 152 is similarly constructed and engages the lower surface of the arm 22. If desired the flanges 154 and 156 can be eliminated from one spool of each pair.

One or more pairs of the spools 150 and 152 are located adjacent each opposite side of the column 12 in the structures formed by housing portions 18, 20 and 78 and the spools 150 and 152 may be supported for rotation in the portions 18, 20, and 78 on shafts 160 or the rollers may have cylindrical end portions (not shown) which cooperate with bearing sleeves located in the structures 18, 20 and 78. Lubricant fittings can also be provided, if desired. Bearing means of the type described provided a good relatively friction free means for supporting the tension bar 22 and have all of the advantages indicated therefor.

FIGS. 9 and 10 show features of an improved brake construction used to lock the upper portions of the machine in different fixed positions during stringing operations. The advantages of the improved means include reduced time and effort to lock and unlock the members, simpler means to perform the same, and means which do not depend on the amount of operator force applied and therefore reduce the chance for wear of the parts and minimize required repair, maintenance and parts replacement.

Figure 3:
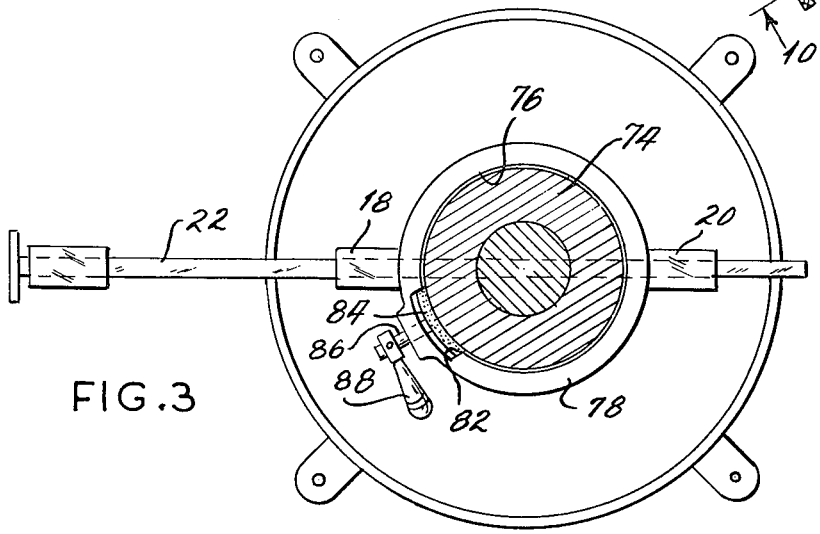
FIG. 3 is a cross-sectional view taken on line 3—3 of FIG. 1.

Referring to FIG. 9, which is a view taken at a location similar to FIG. 3, the member 174 is used instead of the member 74 and is attached to the lower surface of a member similar to the member 72. The member 174 is positioned to be rotated in an annular groove 176 in member 178. The member 174 differs from the member 74 because it has a plurality of teeth or notches 180 formed in its outer surface. Anyone of the teeth 180 can be made to be engaged by one end of a pawl 182 which is pivotally mounted in the member 178, and the pawl 182 is connected to a rod 186 which extends through an opening in a fixed member 188 and is held in position for slideable movement therein by a pin 189 which is positioned in a slot 190. The member 188 is attached to the housing, and the rod 186 extends through the member 188 and is attached to an operator button 192. A compression spring 194 is positioned on the rod 186 between the button 192 and the outer surface of a housing portion 188. When the button 192 is depressed by the operator the pawl 182 is pivoted so that it moves out of engagement with the teeth 180 in the member 174 thereby releasing the brake so that the upper portions of the machine including the racket can be rotated. When the button 192 is released, the compression spring 194 moves it outwardly, thereby allowing the pawl 182 to move into engagement with a tooth 180 in the member 174. If desired, the button 192 and the associated portions can also include means whereby the pawl 182 can be latched in an outward position out of engagement with the member 174 so that the members can be rotated without requiring that the operator hold the button depressed.

Thus there has been shown and described a racket stringing machine for stringing various kinds of rackets such as tennis rackets, badminton rackets, paddle ball rackets, squash rackets, and the like which machine contains various improvements which fulfill all of the objects and advantages sought therefor. It will be apparent to those skilled in the art, however, that many changes, modifications, variations, and other uses and applications for the subject improvements are possible and all such changes, modifications, variations and other uses and applications which do not depart from the spirit and scope of the invention are deemed to be covered by the invention which is limited only by the claims which follow.

What is claimed is:

1. A machine for use in stringing rackets including an upright column having a pedestal portion attached to the lower end thereof for supporting the column in an upright position, means attached to the upper end of the column for supporting a racket during the stringing thereof, said racket supporting means including a first member fixedly attached to the upper end of the column, a second member mounted for rotation adjacent to the first member, an annular groove formed in one of said members and an annular ridge formed on the other member and positioned extending into the annular groove, said ridge having an outer surface defined by a plurality of spaced teeth, means in said one member positioned adjacent to said annular groove including a pawl and means for moving the pawl radially relative to the annular groove and relative to the annular ridge from a position engaged with a selected one of the teeth in the annular ridge to prevent relative movement between the first and second members and a position spaced from the annular ridge whereby the second member and a racket supported thereon can be rotated relative to the first member, means on said column for applying tension to a string being strung on a racket including first means located adjacent to the upper end of the column and adjacent to the racket being strung including means for engaging and holding a string attached to the racket under tension, other means for controlling the position of the string engaging and holding means, said last named means including a lever and means supporting the lever for pivotal movement adjacent to the lower end of the upright column, means operatively connecting the layer to the string engaging and holding means, and means operatively connected to the lever to control the speed of movement of the string engaging and holding means and of the lever during movements thereof.

2. The device defined in claim 1 wherein said speed control means include a hydraulic cylinder.

3. In a machine for stringing rackets or the like comprising a column having pedestal means attached to the lower end thereof to support the column in vertical position and means at the upper end of the column for supporting a racket to be strung, means for tensioning each reach of the string as it is strung on the racket including a pedal operated lever pivotally mounted adjacent to the lower end of the column, a pedal portion adjacent one end of said lever on one side of the column and weight means mounted on said lever on the opposite side of the column from the pedal, a tension bar mounted for horizontal movement adjacent to the upper end of the column, means located adjacent one end of the tension bar for clamping to the string during a string tensioning operation, said clamping means permitting relatively free longitudinal movement of the string in one direction only therethrough, means operatively connecting the pedal operated lever and the string tensioning bar whereby pressure applied to the pedal moves the string tensioning bar in a first direction to a position adjacent to the racket in which position the string is positioned in the clamping means, said tensioning bar moving in an opposite direction away from the racket when the pedal pressure is released under the action of the weight means whereby the string clamping means pulls the string clamped therein away from the racket to apply a predetermined tension to the clamped string depending upon the weight and location on the lever of the weight means, journal means supporting the tension bar during movements thereof, said journal means including spaced pairs of roller members journaled to the column in position to respectively engage opposite side edges of the tension bar, cylinder means connected between the pedal operated lever and the column to dampen movements of the lever and of the string tensioning means connected thereto, means for adjusting the dampening action of the cylinder and hence the speed of movement of the foot pedal and of the string tensioning means, and means to limit movement of the adjustment means.

4. In the racket stringing machine defined in claim 3 means to enable rotation of the racket and of the racket support means relative to the column, and means to lock the racket and racket support means in different fixed positions on said column.

5. In the racket stringing machine defined in claim 4 the means to lock the racket and the racket support means include a member on the racket support means having a plurality of peripheral teeth formed thereon, a pawl located on the column adjacent to the teeth including means on said pawl adapted to engage selected ones of said teeth, and means to move the pawl between a position engaging a selected one of said teeth to prevent rotation of the racket and the racket support means and a position spaced from the teeth whereby the racket and the racket support means can be rotated relative to the column.

6. In a machine for stringing rackets or the like comprising a column having pedestal means attached to the lower end thereof to support the column in vertical position and means at the upper end of the column for supporting a racket to be strung, means for tensioning each reach of the string as it is strung on the racket including a pedal operated lever pivotally mounted adjacent to the lower end of the column, a pedal portion adjacent one end of said lever on one side of the column and weight means mounted on said lever on the opposite side of the column from the pedal, a tension bar mounted for horizontal movement adjacent to the upper end of the column, means located adjacent one end of the tension bar for clamping to the string during a string tensioning operation, said clamping means permitting relatively free longitudinal movement of the string in one direction only therethrough, means operatively connecting the pedal operated lever and the string tensioning bar whereby pressure applied to the pedal moves the string tensioning bar in a first direction to a position adjacent to the racket in which position the string is positioned in the clamping means, said tensioning bar moving in an opposite direction away from the racket when the pedal pressure is released under the action of the weight means whereby the string clamping means pulls the string clamped therein away from the racket to apply a predetermined tension to the clamped string depending upon the weight and location on the lever of the weight means, journal means supporting the tension bar during movements thereof, said journal means including spaced pairs of roller members journalled to the column in position to respectively engage opposite side edges of the tension bar, said racket support means including a pair of spaced support members and racket engaging members having a channel shaped flange in which a portion of the frame of a racket to be strung is positioned, said channel shaped flanges having scalloped edge portions positioned to accommodate respective reaches of string as it is applied to the racket, means for adjusting the space between the racket engaging members so that they can accommodate rackets of different sizes and shapes, and means for clamping the racket frame in the channel shaped fanges of the racket engaging members during stringing thereof.

7. A device for use in stringing rackets including means to support a racket during stringing, means positioned adjacent to the racket support means for gripping and holding a string that is connected to the racket, said gripping and holding means including means which engage the string so as to permit relatively easy movement of the string longitudinally therethrough in one direction only, means operatively connected to the string gripping and holding means to move said means when they are gripping and holding the string in a direction to tension the string, other means to maintain the string under tension independently of the string tensioning means and of the string gripping and holding means, said last named means including means for engaging the string at a location within the frame of the racket being strung, means to prevent the racket from moving during times when tension is applied to the string, said means to tension the string including pedal means actuable by an operator to move the string tensioning means in a direction to release the tension on the string being gripped and held, weight means positioned to operate when pressure is released from the pedal to tension the string at times when the gripping and holding means are engaged with the string, means operatively connected between the pedal means and the string gripping and holding means including a movable bar member and at least two pairs of spaced bearing rollers located to engage opposite sides of the bar member at spaced locations therealong whereby the bar member can move longitudinally therebetween, said bar member having an operative connection to the pedal, to the weight means and to the string gripping and holding means, piston means operatively connected to the string tensioning means to dampen the rate of movement thereof, means associated with the piston means adjustable to vary the dampening effect of the piston means on movements of the string tensioning means, and means to limit movement of the adjustment means.

8. The device for stringing rackets defined in claim 7 including means on the device to mount a racket, said racket mounting means including a pair of spaced support members each having a channel shaped platform thereon for engaging and supporting a different portion of a racket frame, means associated with each platform for engaging the racket frame on the opposite side thereof from the channel shaped platform, and means for clamping the racket frame between the respective platforms and the means associated therewith.

9. The device for stringing rackets defined in claim 8 wherein the means associated with each platform includes an adapter member having a channel formed therein to receive and support a portion of the racket frame therein, said adaptor member having edge portions shaped to permit each reach of string as it is tensioned to be positioned extending closely adjacent to the racket frame and closely adjacent to the position it will be in when the racket is strung.

10. In a machine for stringing rackets having frames and handle portions, the frame portions having wire members with a plurality of spaced loop portions which extend inwardly from around the inner surface of the frame portion through which the string for the racket is threaded, means to apply predetermined tension to each reach of string as it is applied to the racket, said string tension being applied by pulling on the string across the racket frame from a position extending through a wire loop portion on the opposite side of the frame from the tensioning means, means to mount the racket on the machine for rotation between different positions during a stringing operation, said racket mounting means including first and second relatively movable members one of which has a surface defined by spaced teeth with notches therebetween, the other having a movable latch member thereon, said latch member being movable between an operative position extending into a selected one of the notches between adjacent teeth to prevent relative movement between the relatively movable first and second members and an inoperative position spaced from said teeth, yieldable means normally biasing said latch members toward its operative position, and means for gripping and holding the string that is attached to the racket while tension is applied thereto, said gripping and holding means including a pair of string engaging members and means for applying tension to the string when the string holding and gripping means are engaged therewith in a direction to apply tension to the string, and means for locking the racket in a position in which the string reach to which tension is being applied is located closely adjacent to the position it will be in when the racket is strung but with the reach of string being tensioned extending directly between a wire loop on the opposite side of the racket frame and the string gripping and holding means.

11. A machine for stringing rackets including a vertical column having means at the upper end thereof for supporting the racket to be strung, means positioned adjacent to the racket for tensioning each reach of string as it is strung on the racket including operator actuatable means and associated means, weight means operatively connected to the tensioning means, the improvements comprising a tension bar operatively connected between the tensioning means and the operator actuable means, spaced pairs of roller bearing means supporting the tension bar for longitudinal movement therebetween, string clamping means for holding the string under tension during a string tensioning operation, said string clamping means including means to permit movement of the string therethrough in one direction only, means for locking the racket in different predetermined positions relative to the column, said locking means including first and second relatively movable members one of which is attached to the upper end of the column and the other is attached to the racket support means, said first member having a peripheral surface defined by a plurality of spaced indentations, said second member having a pawl pivotally mounted on the column, said pawl having a projection adapted to cooperate with a selected one of the indentations in the first member to lock said first member against relative movement, means operatively connected to the pawl for moving the pawl between a position engaging a selected one of the indentations and a position spaced from said first member, a compression spring associated with said pawl and normally urging the pawl into engagement with an indentation in the first member, said tension bar having a pair of spaced side walls and a pair of spaced edges, said spaced pairs of roller bearing means engaging the pair of spaced side edges on the tension bar at spaced locations therealong, said spring clamping means including a pair of members having adjacent opposed string engaging surfaces thereon, means pivotally supporting one of said members for movement relative to the other, and yieldable means urging said one member toward the other member and toward a length of string positioned therebetween, said racket being locked in a predetermined position during each string tensioning operation such that the reach of string being tensioned extends across the racket frame directly between a location on the racket frame and the string clamping means and substantially in the position that the reach of string being tensioned will be in when the racket is strung.

* * * * *

UNITED STATES PATENT OFFICE

CERTIFICATE OF CORRECTION

PATENT NO. : 3,988,022

DATED : October 26, 1976

INVENTOR(S) : Thurman P. Halbrook

It is certified that error appears in the above-identified patent and that said Letters Patent are hereby corrected as shown below:

Column 4, line 46, delete the word "too" and substitute therefor --- to ---.

Column 7, delete lines 34-54; they are a repetition of matter immediately preceeding them in Col. 7 beginning with the word "across" in line 7 and ending with the "." in line 33.

Column 9, line 14, delete "device" and substitute therefor --- devices ---; same column line 24, delete "jected" and substitute therefor ---ject ---; and same column, line 43, delete "clamped" and insert in its place --- damaged ---.

Column 11, line 24, delete the word "layer" and substitute therefor --- lever ---.

Signed and Sealed this

First Day of February 1977

[SEAL]

*Attest:*

RUTH C. MASON
*Attesting Officer*

C. MARSHALL DANN
*Commissioner of Patents and Trademarks*